US009322519B2

(12) United States Patent
Wang et al.

(10) Patent No.: US 9,322,519 B2
(45) Date of Patent: Apr. 26, 2016

(54) LED FLUORESCENT TUBE

(71) Applicant: Xi'an Heavy Equipment Manufacturing Group Weinan Optoelectronics Technology Co., Ltd., Weinan, Shanxi (CN)

(72) Inventors: Jianzhou Wang, Shanxi (CN); Rui Pan, Shanxi (CN); Zhiqiang Huang, Shanxi (CN); Weiqi Su, Shanxi (CN); Yaolong Hou, Shanxi (CN); Jing Fan, Shanxi (CN)

(73) Assignee: XI'AN HEAVY EQUIPMENT MANUFACTURING GROUP WEINAN OTPOELECTRONICS TECHNOLOGY CO., LTD., Weinan, Shanxi (CN)

( * ) Notice: Subject to any disclaimer, the term of this patent is extended or adjusted under 35 U.S.C. 154(b) by 172 days.

(21) Appl. No.: 14/269,384

(22) Filed: May 5, 2014

(65) Prior Publication Data

US 2014/0334141 A1 Nov. 13, 2014

(30) Foreign Application Priority Data

May 8, 2013 (CN) ..... 2013 1 0167670

(51) Int. Cl.

| | |
|---|---|
| ***F21K 99/00*** | (2010.01) |
| *F21Y 103/00* | (2006.01) |
| *F21Y 101/02* | (2006.01) |

(52) U.S. Cl.

CPC ... *F21K 9/17* (2013.01); *F21K 9/52* (2013.01); *F21Y 2101/02* (2013.01); *F21Y 2103/00* (2013.01)

(58) Field of Classification Search

CPC ..... F21K 9/17; F21K 9/52; F21Y 2101/02; F21Y 2013/00

See application file for complete search history.

(56) References Cited

U.S. PATENT DOCUMENTS

| | | | | |
|---|---|---|---|---|
| 8,556,452 | B2 * | 10/2013 | Simon | B29D 11/00278 362/217.07 |
| 2003/0072147 | A1 * | 4/2003 | Pashley | A47F 3/0482 362/92 |
| 2014/0376217 | A1 * | 12/2014 | Yamada | F21K 9/52 362/217.02 |

* cited by examiner

*Primary Examiner* — Stephen F Husar

(74) *Attorney, Agent, or Firm* — Jackson IPG PLLC; Demian K. Jackson

(57) ABSTRACT

The invention relates to an LED fluorescent tube, characterized in that the tube comprises: a light guide column; two round aluminum substrates or round copper-aluminum bases distributed symmetrically at both sides of the light guide column in the axial direction of the light guide column, gradually far away from the light guide column; two cylindrical hollow column radiators equipped with wire passing holes; and two holders. The LED fluorescent tube of the invention has not only good heat dissipation, but also light weight and excellent energy-saving effect due to the structural advantages.

12 Claims, 1 Drawing Sheet

LED FLUORESCENT TUBE

FIELD OF THE INVENTION

The invention relates to LED technical field, especially an LED fluorescent lamp.

BACKGROUND OF THE INVENTION

With the development of LED light source technology, LED lamps are applied widely. A large quantity of old fluorescent lamps are faced with transition to LED lamps, and how to realize an efficient and economical LED fluorescent lamp becomes a technical problem needing to be solved urgently.

SUMMARY OF THE INVENTION

In order to overcome the above technical problem, the invention provides a novel, creative LED fluorescent lamp.

Therefore, the invention discloses an LED fluorescent tube, characterized in that the tube comprises:

a light guide column; two round aluminum substrates or round copper-aluminum bases distributed symmetrically at both sides of the light guide column in the axial direction of the light guide column, gradually far away from the light guide column; two cylindrical hollow column radiators equipped with wire passing holes; and two holders, wherein:

The light guide column is solid cylinder, and the light transmittance is higher than 92%;

The two aluminum substrates or copper-aluminum bases are distributed symmetrically on the outsides at both sides of the light guide column in the axial direction of the light guide column, and the insides of the two aluminum substrates or copper-aluminum bases point to the light guide column, LED high-power light sources are arranged on the insides, and light from the high-power light sources is led out through the light guide column;

The heat dissipation of the two cylindrical hollow column radiators equipped with wire passing holes is not lower than that of 6063 extruded aluminum profile, the two column radiators are arranged symmetrically on the outsides at both sides of the substrates or bases in the axial direction of the light guide column and, and the side of the two column radiators pointing to the substrates or bases is used as the inside of the column radiators;

The two holders are compatible in specification with those of common fluorescent lamps and are arranged symmetrically on the outsides of the column radiators in the axial direction of the light guide column, and the holders are connected through silicone wires, and further connected to the LED high-power light sources on the substrates or bases through the wire passing holes of the column radiators.

Figure 1:
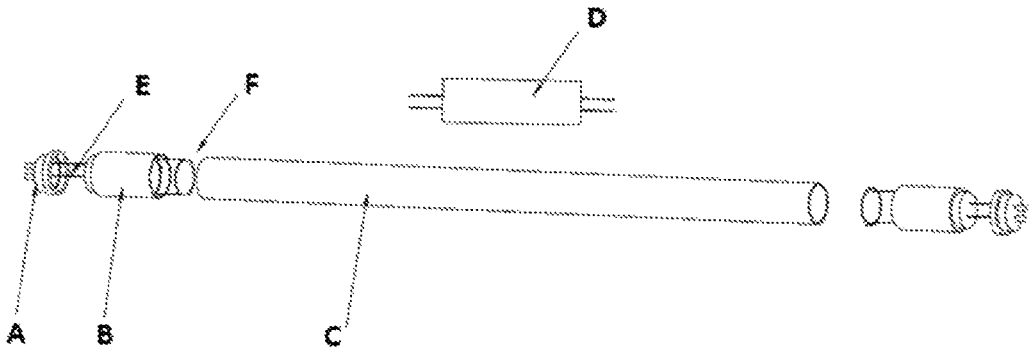
FIG. 1 is a typical drawing of the LED fluorescent tube related to the invention.

A is the holder, B is the column radiator, C is the light guide column, D is the constant current driver switching power supply, E is the silicone wire, and F is the substrate.

DETAILED DESCRIPTION OF THE PREFERRED EMBODIMENTS

In order to realize an efficient and economical LED fluorescent lamp, the invention discloses an LED fluorescent tube, which is characterized in that the tube comprises:

A light guide column; two round aluminum substrates or round copper-aluminum bases distributed symmetrically at both sides of the light guide column in the axial direction of the light guide column, gradually far away from the light guide column; two cylindrical hollow column radiators equipped with wire passing holes; and two holders, wherein:

The light guide column is solid cylinder, and the light transmittance is higher than 92%;

The two aluminum substrates or copper-aluminum bases are distributed symmetrically on the outsides at both sides of the light guide column in the axial direction of the light guide column, and the insides of the two aluminum substrates or copper-aluminum bases point to the light guide column, LED high-power light sources are arranged on the insides, and light from the high-power light sources is led out through the light guide column;

The heat dissipation of the two cylindrical hollow column radiators equipped with wire passing holes is not lower than that of 6063 extruded aluminum profile, the two column radiators are arranged symmetrically on the outsides at both sides of the substrates or bases in the axial direction of the light guide column and, and the side of the two column radiators pointing to the substrates or bases is used as the inside of the column radiators;

The two holders are compatible in specification with those of common fluorescent lamps and are arranged symmetrically on the outsides of the column radiators in the axial direction of the light guide column, and the holders are connected through silicone wires, and further connected to the LED high-power light sources on the substrates or bases through the wire passing holes of the column radiators.

As the embodiment is innovatively compatible with the existing common fluorescent tubes, LED fluorescent lamps are realized without wasting a large amount of materials and costs; in this way, the embodiment can largely reduce the cost of transition to LED fluorescent lamps from common fluorescent lamps and achieve the effects of energy saving and environmental protection. Moreover, for the above embodiment, centering the light guide column, the components from inside to outside in the axial direction of the light guide column are in order: light guide column, substrate or base (equipped with LED high-power light source), column radiator and holder.

Simply, the inside of the column radiators can fastened on the outside of the substrates or bases, taking the principle of being favorable to installation tightness and heat dissipation; the light guide column is also connected to the inside of the column radiators, taking the principle of being favorable to installation tightness and light guiding. Preferably, the light guide column is inserted or fastened on the inside of the column radiators. Through the introduction to the above scheme, it is easy to understand that the inside and outside of the invention are based on that: the inside and outside are divided in the axial direction of the light guide column, the inside is obviously the side close to the light guide column, and the outside is obviously the side far away from the light guide column.

Preferably, in another embodiment: the light guide column is made of glass or PMMA material. The embodiment aims at limiting the material of the light guide column, mainly based on the consideration of light transmittance and weight.

Preferably, in another embodiment: nano-texturing finishing process treatment is applied to the surface of the light guide column The embodiment aims at: when the LED tube is working, the process can anti-reflect internal photons and reduce light loss.

Preferably, in another embodiment: the LED high-power light sources are welded directly on the aluminum substrates, or the chips of the LED high-power light sources are packaged directly on the copper-aluminum bases through COB packaging technology. Here only shows the mode that the light sources are arranged on the substrates or bases, and the invention is not limited to the mode.

Preferably, in another embodiment: according to the power of the LED high-power light sources, the length of the column radiators is adjusted, and the length of the light guide column is adjusted adaptively to keep the length of the LED high-power light sources consistent with that of tubes for common fluorescent lamps; or according to the length design requirements of the light guide column, the power of the LED high-power light sources and the length of the column radiators are adjusted to keep the length of the LED high-power light sources consistent with that of tubes for common fluorescent lamps. The embodiment means that the LED high-power light sources can be balanced effectively between the length of the light guide column and the heat dissipation of the light sources.

Preferably, in another embodiment: the aluminum substrate is 6063 aluminum profile.

Preferably, in another embodiment: the parameters of the constant current driver switching power supply are 14 W, 2.8~3.5V. The embodiment limits a technical solution at a specific power, while the invention is not limited by the specific power; it is assumed to use 14 W, 7 W can be used for each light source because the substrates or bases and the corresponding light sources are arranged at both ends of the tube.

For the substrates or base, the invention is not limited by specific aluminum profile or copper-aluminum material; of course, for the purpose of better heat dissipation, technicians in this field can change heat dissipating materials, and even non-cylindrical structure of the column radiators, and refer to the design of various heat dissipation structures.

Figure 2:
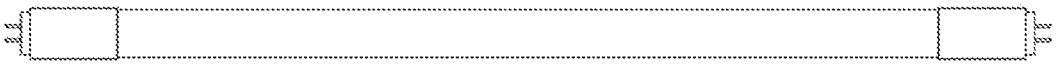
FIG. 2 is an assembly schematic of the typical tube in FIG. 1.

In addition, the invention can be used flexibly for replacement of fluorescent lamps with T5 and T8 holders or transformation of double-end fluorescent lamps. FIG. 1 is the embodiment of an alternative LED high-power fluorescent tube related to the fluorescent tube for G13 holders, and FIG. 2 is the assembly schematic of the alternative LED high-power fluorescent tube.

Specially, the invention discloses a fluorescent lamp using the LED fluorescent tube in any embodiment, in another embodiment: no starter or reflector is used for the fluorescent lamp, an external constant current driver switching power supply is arranged for the fluorescent lamp, nano-texturing finishing process treatment is applied to the surface at the side of the light guide column pointing to the ground, and reflective material vacuum-plating process treatment is applied to the rest surface of the light guide column In other words, use of the reflector from common fluorescent lamps is an option, and the reflector can be omitted, specially when the installation space is limited. When the reflector is not required, the switching power supply can be external, and is fixed at a proper fixing position selected. The emphasis lies on that: the side of the light guide column pointing to the ground is mostly used for lighting, so nano-texturing finishing process treatment is applied to the surface at that side, to anti-reflect internal photons and reduce light loss; meanwhile, when the light guide column itself functions as a reflector, reflective material vacuum-plating process treatment is applied to the rest surface of the light guide column Of course, in another embodiment: when the tube is used for 360° lighting, such as for landscape lamps, reflective material vacuum-plating is not required; in other words, nano-texturing finishing process treatment is applied to the whole surface of the light guide column.

In addition, in another embodiment: no starter is used for the fluorescent lamp, the reflector is used for the fluorescent lamp, the housing is arranged at the reflector, and the external constant current driver switching power supply is arranged in the housing to replace the ballast used for common fluorescent lamps. In this way, the fluorescent lamp uses the reflector of common fluorescent lamps and its housing for arranging the power supply, and the switching power supply is unnecessary to be external.

To sum up, compared with the prior art, the invention can largely reduce the cost of transition to LED fluorescent lamps from common fluorescent lamps due to the flexibility of each part and the selective use of old materials. The LED fluorescent tube of the invention has not only good heat dissipation, but also light weight and excellent energy-saving effect due to the structural advantages.

The above contents introduce in details the methods provided by the invention, the specific examples used in this text describe the principle and detailed description of the invention, and the description of the above embodiments is used only for helping understand the method and core idea of the invention; meanwhile, for technicians in this field, the detailed description and application scope will change according to the idea of the invention. In a word, the content of the Description shall not be understood as limit to the invention.

What is claimed is:

1. An LED fluorescent tube, comprising: a light guide column; two round aluminum substrates or round copper-aluminum bases distributed symmetrically at both sides of the light guide column in axial direction of the light guide column, gradually far away from the light guide column; two hollow cylindrical column radiators equipped with wire passing holes; and two holders, wherein:

the light guide column is solid cylinder, and the light transmittance is higher than 92%;

the two aluminum substrates or copper-aluminum bases are distributed symmetrically on the outsides at both sides of the light guide column in the axial direction of the light guide column, and insides of the two aluminum substrates or copper-aluminum bases point to the light guide column, LED high-power light sources are arranged on the insides, and light from the LED high-power light sources is led out through the light guide column;

heat dissipation of the two hollow cylindrical column radiators equipped with wire passing holes is not lower than that of 6063 extruded aluminum profile, the two column radiators are arranged symmetrically on the outsides of the substrates or bases in the axial direction of the light guide column, and the side of the two column radiators pointing to the substrates or bases is used as the inside of the column radiators;

the two holders are compatible in specification with those of common fluorescent lamps and are arranged symmetrically on the outsides of the column radiators in the axial direction of the light guide column, and the holders are connected to the LED high-power light sources on the substrates or bases with silicone wires through the wire passing holes of the column radiators.

2. The LED fluorescent tube according to claim 1, wherein nano-texturing finishing process treatment is applied to the surface of the light guide column.

3. The LED fluorescent tube according to claim 1, wherein the LED high-power light sources are welded directly on the aluminum substrates, or the chips of the LED high-power light sources are packaged directly on the copper-aluminum bases through COB packaging technology.

4. The LED fluorescent tube according to claim 1, wherein the aluminum substrate is 6063 aluminum profile.

5. The LED fluorescent tube according to claim 1, wherein the light guide column is made of glass or PMMA material.

6. The LED fluorescent tube according to claim 5, wherein nano-texturing finishing process treatment is applied to the surface of the light guide column.

7. The LED fluorescent tube according to claim 5, wherein the LED high-power light sources are welded directly on the aluminum substrates, or the chips of the LED high-power light sources are packaged directly on the copper-aluminum bases through COB packaging technology.

8. The LED fluorescent tube according to claim 5, wherein the aluminum substrate is 6063 aluminum profile.

9. The LED fluorescent tube according to claim 1, wherein, according to power of the LED high-power light sources, length of the column radiators is adjusted, and length of the light guide column is adjusted adaptively to keep length of the LED high-power light sources consistent with that of tubes for common fluorescent lamps; or according to the length design requirements of the light guide column, the power of the LED high-power light sources and the length of the column radiators are adjusted to keep the length of the LED high-power light sources consistent with that of tubes for common fluorescent lamps.

10. A fluorescent lamp using the LED fluorescent tube according to claim 9, characterized in that: no starter or reflector is used for the fluorescent lamp, an external constant current driver switching power supply is arranged for the fluorescent lamp, nano-texturing finishing process treatment is applied to the surface at the side of the light guide column pointing to the ground, and reflective material vacuum-plating process treatment is applied to the rest surface of the light guide column.

11. A fluorescent lamp using the LED fluorescent tube according to claim 9, characterized in that: no starter or reflector is used for the fluorescent lamp, an external constant current driver switching power supply is arranged for the fluorescent lamp, and nano-texturing finishing process treatment is applied to the whole surface of the light guide column when the tube is used for 360° lighting.

12. A fluorescent lamp using the LED fluorescent tube according to claim 9, characterized in that: no starter is used for the fluorescent lamp, the reflector is used for the fluorescent lamp, a housing is arranged at the reflector, and the external constant current driver switching power supply is arranged in the housing to replace the ballast used for common fluorescent lamps.

* * * * *